US005272786A

United States Patent [19]

Edström

[11] Patent Number: 5,272,786

[45] Date of Patent: Dec. 28, 1993

[54] HOUSEHOLD SCRAPER

[76] Inventor: Lars-Anders Edström, Soldatgatan 24, S-961 45 Boden, Sweden

[21] Appl. No.: 651,212

[22] PCT Filed: Jun. 27, 1989

[86] PCT No.: PCT/SE90/00421

§ 371 Date: Mar. 5, 1991

§ 102(e) Date: Mar. 5, 1991

[87] PCT Pub. No.: WO90/01289

PCT Pub. Date: Feb. 22, 1990

[30] Foreign Application Priority Data

Aug. 4, 1988 [SE] Sweden ..... 8802820

[51] Int. Cl.[5] ..... A47L 13/02; A47L 17/06

[52] U.S. Cl. ..... 15/236.07; 15/236.01

[58] Field of Search ..... 15/236.01, 236.07, 236.08, 15/236.09, 245; 30/169; D32/41, 46

[56] References Cited

U.S. PATENT DOCUMENTS

| | | | |
|---|---|---|---|
| D. 54,311 | 12/1919 | Ellis | D32/46 |
| D. 221,244 | 7/1971 | Lawrence | 15/236.07 |
| 1,091,960 | 3/1914 | Rasky | 15/111 |
| 1,367,032 | 2/1921 | Ferdon | 15/236.01 |
| 1,460,007 | 6/1923 | Williams | 15/236.07 |
| 1,538,521 | 5/1925 | Sheridan | 30/169 |
| 1,746,877 | 2/1930 | Tompkins | 15/236.01 |
| 2,188,114 | 1/1940 | Hubbard | 15/245 |
| 2,338,647 | 1/1944 | Koon | 15/236.08 |
| 2,824,330 | 2/1958 | Williams | 15/245.1 |
| 3,256,548 | 6/1966 | Peterson | 15/236.01 |
| 3,800,352 | 4/1974 | Bonora | 15/105 |
| 4,784,598 | 11/1988 | Kranz et al. | 15/245 |

FOREIGN PATENT DOCUMENTS

| | | | |
|---|---|---|---|
| 358979 | 9/1922 | Fed. Rep. of Germany . | |
| 0707275 | 6/1941 | Fed. Rep. of Germany | 15/236.07 |
| 2651924 | 6/1978 | Fed. Rep. of Germany . | |
| 0605841 | 7/1948 | United Kingdom | 15/236 R |

*Primary Examiner*—Harvey C. Hornsby
*Assistant Examiner*—Tony G. Soohoo
*Attorney, Agent, or Firm*—Cushman Darby & Cushman

[57] ABSTRACT

A household scraper for cleansing kitchen sinks and the like. The scraper includes a central, curved or recessed part which is perforated with a number of holes. The scraper also includes a curved bottom edge and two side-edges which are also curved. An outwardly angled zone is provided between the central part and the lower edge. This outwardly angled zone also extends between the central part and a bottom section of the side-edges of the scraper. The scraper is made, for instance, of a plastics material and enables waste material, for instance food residues, to be collected and removed in an expedient, effective and time-saving manner. The holes provided in the center part of the scraper enable liquid contained by the food residues to drain-off while collecting the waste material.

6 Claims, 2 Drawing Sheets

HOUSEHOLD SCRAPER

BACKGROUND OF THE INVENTION

The present invention relates to a household scraper for cleansing kitchen sinks and the like.

Waste material in the form of food residues and the like is mostly removed from kitchen sinks and like spaces with the aid of kitchen paper. This task is often dirty and unpleasant, and also consumes large quantities of kitchen paper.

SUMMARY OF THE INVENTION

The object of the present invention is to provide a household scraper by means of which a kitchen sink or a like space can be cleansed of waste material, such as food residues, in a simple and practical fashion.

BRIEF DESCRIPTION OF THE DRAWING

The invention will now be described in more detail with reference to an exemplifying embodiment thereof illustrated in the accompanying drawing, in which.

DETAILED DESCRIPTION

Figure 1:
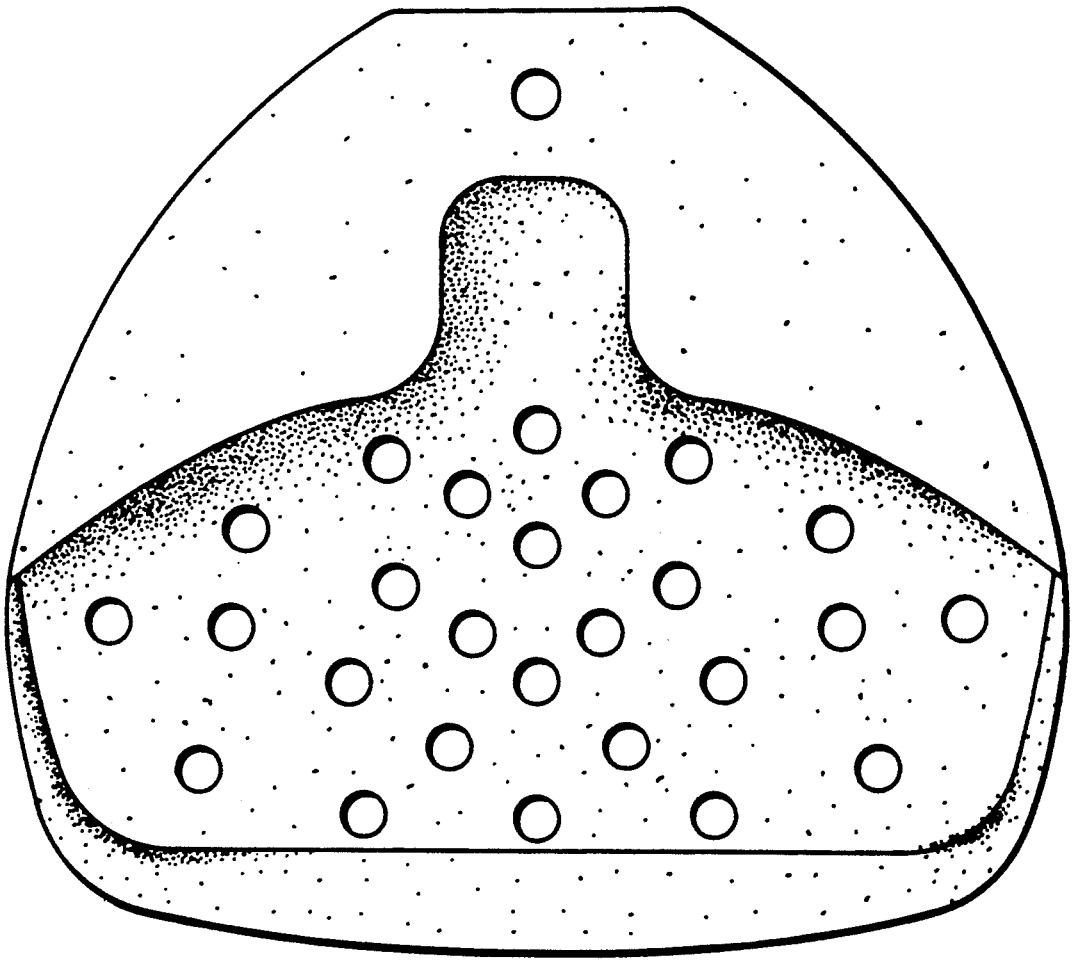
FIG. 1 is a front view of a scraper embodying principles of the present invention.
Figure 2:
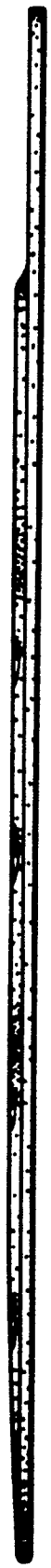
FIG. 2 illustrates the scraper from one side thereof.

The scraper of the present invention is preferably made of sheet metal, plastics or some similar flexible material, so that the scraper can be caused to conform to the configuration of a kitchen sink, for instance, when in use. That is, the scraper is flexible biaxially (left to right and top to bottom with reference to its front face.

The scraper has a central, curved, bent or recessed part 1 which is perforated with a plurality number of holes 2. The central and recessed part of the scraper merges with a bottom edge 3 via an angled zone 7. The edge 3 is slightly curved. The central and recessed part 1 of the scraper merges on respective sides of the bottom edge 3 with two side-edges 4 and 5, which are also slightly curved. An upper edge 6 connects the side-edges 4 and 5 in the upper part of the scraper. The upper part of the scraper is provided with a hole 8, by means of which the scraper can be hung on a hook or like device provided, for instance, above the sink, so that the scraper will always be available for use.

The scraper is used in the following manner. When wishing to remove waste material, such as food residues and the like, from a kitchen sink, the scraper is gripped by user, with the user's thumb preferably in the upper region 9 of the centre part 1 of the scraper, with the fingers of the user's hand located on the rear side of the scraper. The scraper is then moved along the surface of the sink, so as to cause the lower edge 3 of the scraper to slide along the sink bottom, wherewith the waste material will slide up the angled zone 7 and rest on the centre part 1 of the scraper. Since the centre part 1 of the scraper has a hollowed or recessed configuration, the waste collected will remain on the scraper. Such waste is often wet, and the perforations 2 provided in the scraper enable the liquid present to drainoff, therewith preventing liquid from reaching the region in which the scraper is gripped. Subsequent to shaking-off the waste collected and drained on the scraper, for instance into a rubbish or garbage bag, the scraper is rinsed by the user, preferably under running tap water.

Due to the flexibility of the scraper, the scraper will readily conform to the shape of the surfaces on which it is used and therewith cleanse said surfaces from, e.g., waste material in a particularly effective and time-saving manner.

It will be seen that the scraper of the invention can be used in many different fields to that described.

The invention is not restricted to the illustrated and described embodiment, and changes and modifications are conceivable within the scope of the following claims.

I claim

1. A household scraper for scraping food waste from surfaces of varying contour of a kitchen sink, comprising:

a plate of biaxially flexible material having a front surface, a rear surface opposed to said front surface, and a perimeter bounding said front and rear surfaces, said perimeter being an edge which includes laterally opposed left and right edge portions, a lower edge portion extending between said left and right edge portions, and an upper portion extending between said left and right edge portions so as to provide in succession about said perimeter, said lower edge portion, said left edge portion, said upper portion, and said right edge portion, all with reference to said front surface;

said lower edge portion being downwardly convex in a left-to-right sense along said lower edge portion between said left and right edge portions;

said plate having a lower zone which borders said lower edge portion;

said plate having a central portion which extends upwards from said lower zone, and into adjacency with said left and right edges;

said plate having said front surface within all of said central portion thereof being broadly and shallowly recessed rearwardly relative to said perimeter and said front surface; and having means defining a plurality of drain holes therethrough, said drain holes being widely distributed throughout said central portion;

said plate, having an upper portion, separated from said lower zone by intervention of said central portion, said upper portion being arranged to be engaged between a user's thumb on the front surface and a user's fingers on the rear surface for biaxially flexing the plate as said lower edge portion is scraped along in conformity with surfaces of varying contour of a kitchen sink.

2. The scraper of claim 1, wherein:

said upper portion, in a medial region thereof which is contiguous with said central portion, but is laterally substantially narrower than said central portion, is forwardly concave relative to said front surface, for receiving the user's thumb.

3. The scraper of claim 2, further including:

means defining a hole extending thicknesswise through said plate in said upper portion, for hanging said scraper on a hanger.

4. The scraper of claim 1, wherein:

said left and right edges are both laterally outwardly convex relative to said front surfaces.

5. The scraper of claim 1, wherein:

on said front surface said lower zone slopes forwards and downwards from said central portion to said lower edge.

6. The scraper of claim 5, wherein:

said lower zone has left and right end extension portions which extend up on laterally opposite sides of said central portion towards said upper portion and border said left and right edges, and in which said front surface slopes forwards and outwards from said central portion to said left and right edges as seen from said front surface.

* * * * *